United States Patent [19]

Christin et al.

[11] 4,184,268

[45] Jan. 22, 1980

[54] DRYER DRUM FOR A PAPER MAKING MACHINE

[75] Inventors: Alan Christin, Ravensburg; Anton Zembrot, Aulendorf, both of Fed. Rep. of Germany

[73] Assignee: Escher Wyss GmbH, Ravensburg, Fed. Rep. of Germany

[21] Appl. No.: 824,728

[22] Filed: Aug. 15, 1977

[30] Foreign Application Priority Data

Aug. 27, 1976 [CH] Switzerland ..... 10881/76

[51] Int. Cl.[2] ..... D21F 5/10

[52] U.S. Cl. ..... 34/124

[58] Field of Search ..... 34/124, 125, 119; 165/89, 90

[56] References Cited

U.S. PATENT DOCUMENTS

| | | | |
|---|---|---|---|
| 2,563,692 | 8/1951 | Ostertag et al. | 34/124 X |
| 3,241,251 | 3/1966 | Justus et al. | 34/124 |
| 3,359,647 | 12/1967 | Webb | 34/124 |

*Primary Examiner*—Leonard E. Smith

*Attorney, Agent, or Firm*—Kenyon & Kenyon

[57] ABSTRACT

The dryer drum is provided with header pipes which are rotatable about their axes so that the scavenging pipes can be serviced from within the shell of the drum. The drain pipes are detachable from the header pipes and the drain line to permit rotation of the header pipes. Radial tie rods and U-shaped brackets support the header pipes on the steam drum within the shell.

12 Claims, 4 Drawing Figures

1
2
3
4
5
6
7
8
10
11
12
13
14
15
16
17
18
20
21
22
23
24
III
III

DRYER DRUM FOR A PAPER MAKING MACHINE

This invention relates to a dryer drum for a paper making machine and, particularly, to a mounting arrangement for a header pipe of a dryer drum.

As is known, dryer drums for paper making machines generally have a cylindrical shell which encloses a chamber supplied with steam and is provided with annular ribs and grooves on an interior wall. When in use, the steam condenses on the ribbed wall of the shell via a heat exchange with a paper web passing over the outer surface of the shell. In order to remove the condensate, the dryer drums are generally provided with scavenging pipes which protrude from a header pipe into the grooves. The header pipe is, in turn, usually located in the vicinity of the inner wall of the shell, runs parallel to the axis of the shell and is connected to a drain line for the condensate. A dryer drum of this kind is known, for example, from German Pat. No. 1,604,793 (U.S. Pat. No. 3,241,251).

In the known dryer drums, a number of header pipes are distributed equally round and within the circumference of the shell. In the event of wear or any other kind of damage to the scavenging pipes, which are relatively fine and thin-walled, the dryer drum must be dismantled and the header pipes and the scavenging pipes must be removed. This is a time consuming operation which decreases the production time not only of the dryer drum but also of the paper making machine.

Further, because the scavenging pipes are usually rigidly fixed in the header pipes, it has not been possible to alter the position of the scavenging pipes relative to the grooves in order to attain a desired heating effect of the steam at the surface of the drum.

Accordingly, it is an object of the invention to provide a dryer drum in which the scavenging pipes are easily accessible for the possible purpose of changing them or altering their position.

It is another object of the invention to reduce the downtime of a dryer drum during servicing.

It is another object of the invention to avoid dismantling of a dryer drum in order to replace a condensate scavenging pipe.

Briefly, the invention provides a dryer drum for a paper making machine which includes a cylindrical shell having an interior wall and a plurality of annular ribs disposed on the wall to define grooves. In addition, at least one header pipe is mounted about a longitudinal axis thereof within the shell in parallel to the axis of the shell so as to be selectively rotatable about the axis relative to the shell. A plurality of scavenging pipes are connected to the header pipe in order to project into the respective grooves to remove condensate therefrom. Also, a drain line is connected to the header pipe for draining condensate therefrom.

The mounting arrangement of the header pipe allows the header pipe to be detached and rotated when the dryer drum is cooled and vented. As is known, the space inside the known dryer drums is usually large enough to allow access to the space for this purpose and to perform the operation inside the drum. In this way, the scavenging pipes which protrude into the grooves in the operating condition and point toward the inner wall of the shell are accessible from the space within the drum.

The header pipe can be connected to the drain line by way of a drain pipe which is detachably connected to both the header pipe and the drain line in order to convey the condensate therebetween. The detachable arrangement of this drain pipe facilitates rotation of the header pipe without interference from the drain line. Alternatively, under certain circumstances a rotatable coupling may also be provided between the header pipe and the drain line.

It is of advantage if at least some of the scavenging pipes are fixed in the header pipe so as to be adjustable in their longitudinal direction. By varying the layer of water remaining in the grooves of the shell, it is possible to influence the heating effect of the steam on the surface of the drive drum. In this regard, the scavenging pipes adjacent each end of the shell are adjustably mounted in the header pipe radially of the longitudinal axis of the layer pipe in order to influence the heating effect of the steam condensing inside the drum. As the paper web being dried ceases to have a cooling effect at the ends of the drum shell, the adjustment of the scavenging pipes allows an increased flow of heat from the ends of the drum and particularly the end covers which are usually arranged at the ends of the drum.

The dryer drum also includes a steam drum which is located in a central region of the shell in order to conduct a flow of steam to the wall of the shell. In addition, a means is provided for securing the header pipe to the steam drum. In this regard, this means includes a plurality of radial tie rods which are secured to the steam drum and a plurality of U-shaped brackets which are disposed about the header pipe. Each of these brackets has a pair of threaded shanks which pass through a respective tie rod and nuts are provided on each shank for securing each respective bracket to a respective tie rod. The tie rod thus allows the header pipe to be supported uniformly over the entire length of the pipe against the effects of gravity and centrifugal force. Further, the U-shaped brackets permit a rotatable connection between the header pipe and the tie rods such that the header pipe can be fixed by tightening of the nuts and released for rotation by loosening of the nuts.

In addition, each securing means may employ a bolt which is threaded into a respective tie rod and is disposed in abutting relation to the header pipe. In this way, the position of the header pipe can be adjusted radially of the dryer drum.

Further, the shell of the drum has a radial flange at each end which is directed towards the axis of the shell while the header pipe has a journal at each end opposite a respective flange. In addition, a stationary bearing housing is disposed at each end of the header pipe between the header pipe and a respective shell flange while a spherical bearing surface is disposed on each journal of the header pipe and is rotatably mounted in a respective bearing housing. The housings may also be fixed via suitable bolts to the flanges of the shell. This arrangement provides a support for the ends of the header pipe so that the pipe can rotate and pivot, i.e. cannot jam. Also, the arrangement fixes the bearing housing in such a manner that there is no need for additional holes in the shell which would otherwise weaken the walls of the dryer drum.

These and other objects and advantages of the invention will become more apparent from the following detailed description and appended claims taken in conjunction with the accompanying drawings in which:

Figure 1:
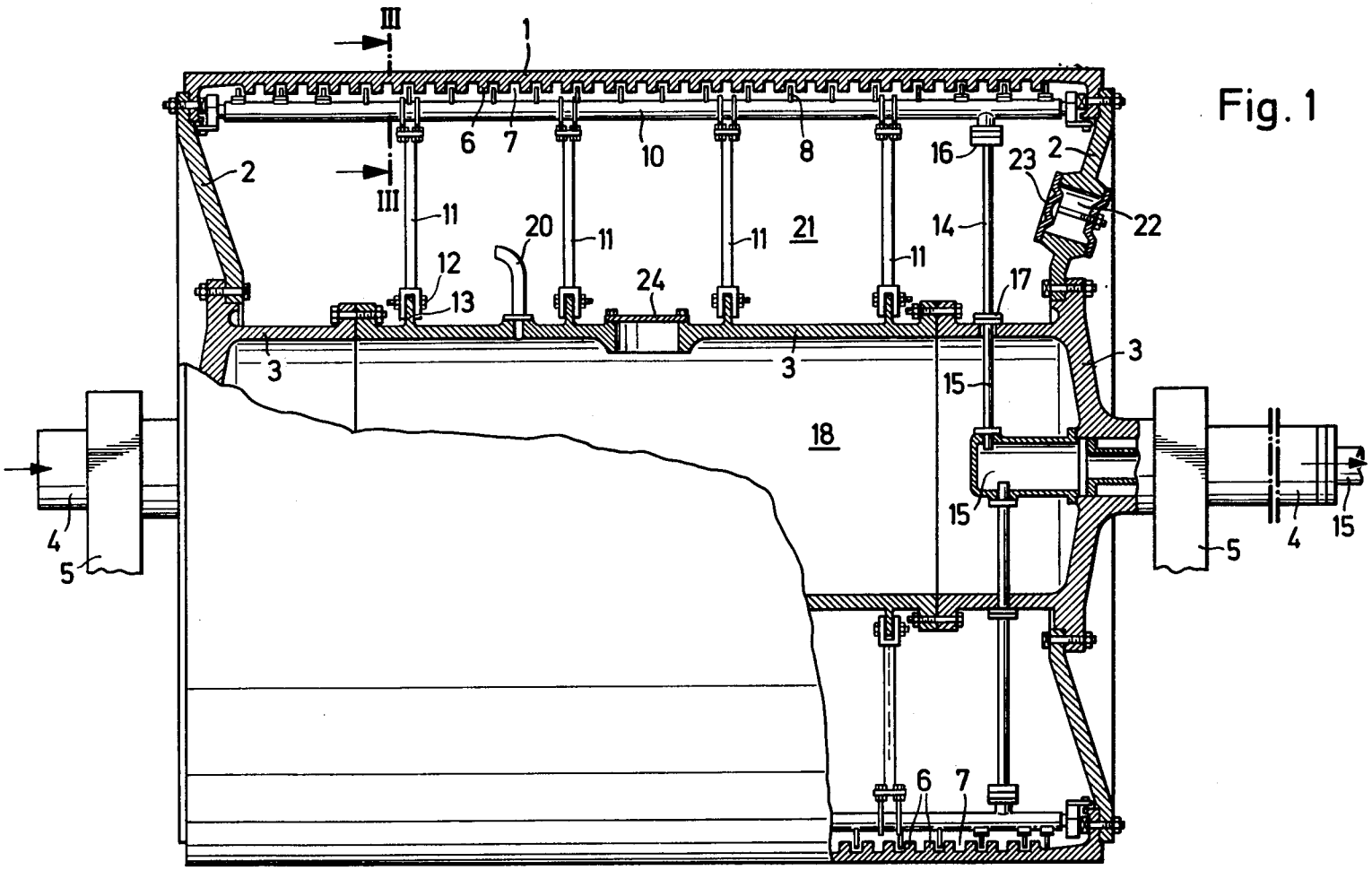
FIG. 1 illustrates a partial sectional view of a dryer drum constructed in accordance with the invention.

Referring to FIG. 1, the dryer drum which is used for drying a paper web in a paper making machine includes a cylindrical shell 1 which is disposed for rotation about a longitudinal axis. As shown, the shell 1 is secured via suitable bolts to two end covers 2 which, in turn, are secured by bolts to a steam drum 3 which is located in a central region of the shell 1. The steam drum 3 includes journals 4 which support the drum in supports 5 and allow the dryer drum to rotate.

Figure 3:
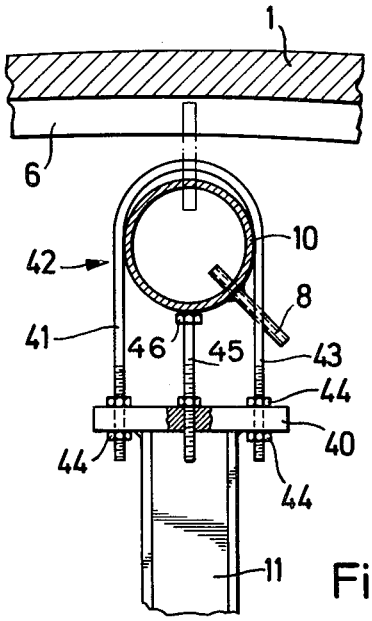
FIG. 3 illustrates a view taken on line III—III of FIG. 1.

The cylindrical shell has an interior wall which is provided in known manner with a plurality of annular ribs 6 to define grooves 7 therebetween. In addition, a plurality of scavenging pipe 8 project into the grooves 7 from header pipes 10 located in parallel to the axis of the cylindrical shell 1. Each header pipe 10 is secured by a suitable releasable securing means to the steam drum 3 so as to be uniformly supported throughout against the effects of gravity and centrifugal force. For example, this securing means includes a plurality of radial tie rods 11 of I-section which are secured to the steam drum 3. As shown, the tie rods 11 are each attached by means of bolts 12 to annular flanges 13 on the drum 3. In addition, a plurality of U-shaped brackets 42 (FIG. 3) are disposed about each header pipe 10 and are secured to a respective tie rod 11. As shown in FIG. 3, each tie rod 11 carries a plate 40 which is welded to the end and each bracket 42 has a pair of threaded shanks 41 which pass through suitable holes in the plate 40. Each shank 41 has a thread 43 on which two nuts 44 are threaded to either side of the fixing plate 40. In addition, a bolt 45 is disposed between the shanks 41 of each bracket 42. As shown, the bolt 45 is threaded into the plate 40 of a tie rod 11 and is disposed in abutting relation to the header pipe 10 via a head 46. This head 46 serves to support the header pipe 10 within the bracket 42. By adjusting the bolt 45 and the nuts 44 on the shanks 41 of the bracket 42, the position of the header pipe 10 can be adjusted relative to the steam drum 3 and the wall of the cylindrical shell 1. Further, by releasing the nuts 44 and/or bolts 45 the header pipe 10 is allowed to rotate.

Referring to FIG. 1, each header pipe 10, of which there are several distributed uniformly about the circumference of the cylinder, are joined by drain pipes 14 to a drain line 15 which leads to the outside through the right-hand journal 4, as viewed. Each drain pipe 14 is detachably connected to both a header pipe 10 and the drain line 15 via flanges 16, 17 in order to convey condensate therebetween.

The steam drum 3 encloses a steam space or chamber 18 which is connected via a duct (not shown) in the left hand journal, as viewed, to a source of steam at suitable pressure. In addition, steam pipes 20 lead from the steam space 18 into a chamber 21 which is bounded by the shell 1, the end covers 2 and the cylindrical outer wall of the drum 3. One annular end cover 2 is provided with a manhole 22 which is closed by a suitable manhole cover 23 and allows access to the chamber 21. In addition, a cover 24 is provided in the steam drum 3 so as to permit access to the steam space 18 when opened and when the dryer drum is not operating, i.e. when the dryer drum is cooled and vented.

Figure 2:
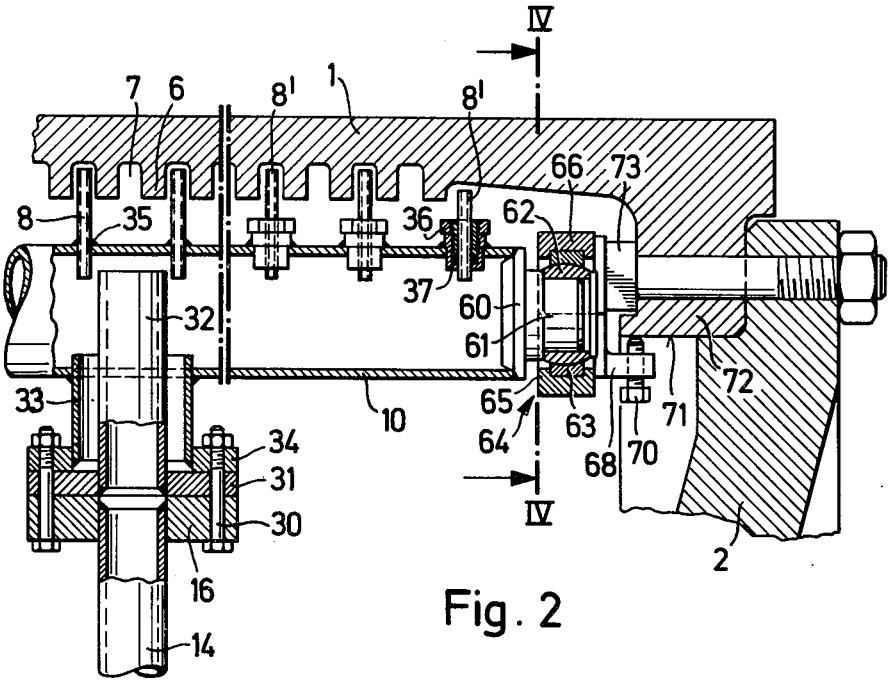
FIG. 2 illustrates a partial cross-sectional view of a mounting arrangement for a header pipe within a dryer drum in accordance with the invention.

Referring to FIG. 2, the detachable connection between a drain pipe 14 and the header pipe 10 employs a stub shaft arrangement. To this end the flange 16 on a drain pipe 14 mates with a flange 31 of a pipe stub 32 and is secured thereto by bolts 30. The pipe stub 32 leads from the flange 31 into the header pipe 10 to provide a direct connection and is surrounded by a pipe stub 33 which is fixed to a flange 34 also joined to the flange 31 via the bolts 30. This latter pipe stub 33 avoids thermal stressing of the pipe stub 32. In addition, the pipe stub 33 is secured as by welding to the header pipe 10 as shown.

The scavenging pipes 8 are located in a region of the shell spaced from the ends of the shell 1. These scavenging pipes 8 are fixed in the header pipe 10 by a welded or brazed joint 35. Additional scavenging pipes 8′ are located at the ends of the header pipe 10 in the end regions of the shell 1 and are fixed in threaded nipples 36 having sealing rings 37. In this way the scavenging pipes 8′ are adjustably mounted in the header pipe 10 radially of the longitudinal axis of the header pipe 10. By unscrewing the threaded nipples 36, the scavenging pipes 8′ can be withdrawn from, or inserted into, the header pipe 10.

Figure 4:
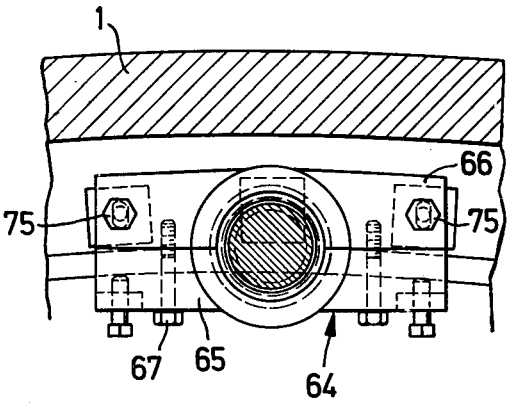
FIG. 4 illustrates a view taken on line IV—IV of FIG. 2.

Referring to FIGS. 2 and 4, each header pipe 10 is provided at each end with a cap or cover 60 on which a journal 61 is formed. In addition, a spherical bearing surface formed by a ring 62 is disposed on each journal 61. Each ring 62 is, in turn, journalled in a spherical bearing shell 63 mounted in a bearing housing 64. As is known, the rings 62 are able to rotate and swivel in the spherical bearing shell 63. The bearing housing 64 also consists of two parts 65, 66 (FIG. 2) which are joined together with screws 62.

As shown in FIG. 2, the housing parts 65 are provided with projecting tabs 68 in which screws 70 are fitted to bear against a surface 71 of a flange 72 of the cylindrical shell 1 in the radial direction of the dryer drum. The housing parts 66 are supported laterally on the head 73 of the bolt 74 which serves to join the cylindrical shell 1 to the end of the cover 2. If appropriate, screws 75 can be provided which pass through the housing parts 66 in a manner not shown and thread into the heads 73 of the bolts 74.

Referring to FIG. 1, in operation, steam of suitable pressure and temperature flows in known manner into the steam space 18. The steam then passes through the pipes 20 from the steam space 18 into the chamber 21 and condenses on the walls of the chamber 21, especially on the inner surface of the cylindrical shell 1. The shell 1 is cooled during this time on the outside by the paper web being dried. The condensate which forms collects under the influence of centrifugal force in the grooves 7 and due to a pressure difference between the chamber 21 and the drain line 15, is forced into the scavenging pipes 8, the header pipes 10 and the drain line 15. Some of the steam is also drawn out of the chamber 21 and is separated in known manner outside the dryer drum in a steam separator (not shown).

If the scavenging pipes 8 are to be made accessible so that they can be changed or cleaned, for example, after the dryer drum has been shut down, the manhole cover 23 is opened to permit entry to the chamber 21. The drain pipe or pipes 14 can then be removed by unthreading the bolts in the respective flanges 16, 17. Next, the nuts 44 on the U-shaped brackets 42 can be loosened and the header pipe 10 in question can be rotated as shown in FIG. 3 so that the scavenging pipes 8 point inwardly. These scavenging pipes 8 can then be cleaned or replaced.

After cleaning the scavenging pipes 8 can be returned to their normal position by turning back the header pipe 10. Thereafter, the nuts 44 can be tightened and the drain pipe 14 re-fitted. The header pipe 10 is fixed in position by tightening the nuts 44 with the distance from the inside wall of the shell 1 being adjustable via the bolt 45.

The scavenging pipes 8' which are secured at the ends of the header pipes 10 allow a variation of the heating effect of the steam and, hence, of the temperature in the end portions of the shell 1. These end portions are only inadequately cooled by the wet web of paper being dried since the paper does not usually extend to the edge of the outer surface of the shell 1. Moreover, there is a greater supply of heat at these end portions because heat is also fed to the ends of the shell 1 via the end covers 2. In order to obtain the required cooling effect in the end portions of the shell 1, the scavenging pipes 8' can be sets so that a greater or lesser amount of condensate remains in the groove 7. As steam condenses, the condensate acts as a thermally insulating layer.

The bearing housing 64 with the spherical support of the journals 61 not only permit a rotary movement of the header pipe 10 but also permit swivelling movements relative to the axis of the shell 1 caused by flexure of the header pipes 10. As can be seen from FIGS. 2 and 4, each bearing housing 64 is fixed in the shell 1 in such a way that no other openings are required, either in the shell 1 or in the end cover 2. Thus, weakening of the dryer drum by the provision of holes or openings is thus avoided.

It is to be noted that the detachable connection of the drain pipes 14 to the drain line 15 is of conventional structure. To this end, the drain line 15 includes a centrally located conduit with radially directed lines which carry flanges at the outer extremities for a bolted connection with the flanges 17 of the drain pipes 14. Similarly, the inner extremities of the lines may be connected to the conduit via a flange on the line and a spigot on the conduit as indicated in FIG. 1.

What is claimed is:

1. A dryer drum for a paper-making machine comprising a cylindrical shell disposed for rotation about a longitudinal axis thereof, said shell having an interior wall and a plurality of annular ribs disposed on said wall to define grooves therebetween;

at least one header pipe mounted about a longitudinal axis thereof within said shell parallel to said axis of said shell;

means journalling each end of said header pipe for rotation about said longitudinal axis;

releaseable securing means for fixing said header pipe in a predetermined position about said axis and relative to said shell;

a plurality of scavenging pipes connected to said header pipe for projecting into said respective grooves to remove condensate therefrom in said predetermined position of said header pipe; and a drain line detachably connected to said header pipe for draining condensate therefrom whereby upon release of said securing means said header pipe is allowed to rotate in said journalling means about said longitudinal axis thereof.

2. A dryer drum as set forth in claim 1 further comprising a drain pipe detachably connected to said header pipe and to said drain line to convey condensate therebetween.

3. A dryer drum as set forth in claim 1 wherein at least some of said scavenging pipes are adjustably mounted in said header pipe radially of said longitudinal axis of said header pipe.

4. A dryer drum as set forth in claim 1 wherein said scavenging pipes adjacent each end of said shell are adjustably mounted in said header pipe radially of said longitudinal axis of said header pipe.

5. A dryer drum as set forth in claim 1 further comprising a steam drum located in a central region of said cylinder and a plurality of radially disposed tie rods mounting said header pipe on said steam drum.

6. A dryer drum as set forth in claim 5 further comprising a plurality of U-shaped brackets disposed about said header pipe, each said bracket having a pair of threaded shanks passing through a respective tie rod and nuts on each shank for securing each respective bracket to a respective tie rod.

7. A dryer drum as set forth in claim 6 further comprising a plurality of bolts, each said bolt being threaded into a respective tie rod and being disposed in abutting relation to said header pipe.

8. A dryer drum as set forth in claim 6 wherein said shell has a radial flange at each end directed towards said axis of said shell and said header pipe has a journal at each end opposite a respective flange, and which further comprises a stationary bearing housing at each end of said header pipe between said header pipe and a respective flange, and a spherical bearing surface on each respective journal and rotatably mounted in a respective bearing housing.

9. A dryer drum for a paper making machine comprising a cylindrical shell having an interior wall and a plurality of annular ribs disposed on said wall to define grooves therebetween;

a steam drum located in a central region of said shell to conduct a flow of steam to said wall;

at least one header pipe mounted about a longitudinal axis thereof within said shell, said pipe being selectively rotatable about said longitudinal axis thereof relative to said shell;

means journalling each end of said header pipe for rotation about said longitudinal axis;

releaseable securing means for fixing said header pipe in a predetermined position about said axis and relative to said shell;

a plurality of scavenging pipes connected to said header pipe for projecting into said respective grooves to remove condensate therefrom;

a drain line for draining condensate; and a drain pipe detachably secured between and to said header pipe and said drain line to drain condensate from said header pipe to said drain line whereby upon release of said securing means said header pipe is allowed to rotate in said journalling means about said longitudinal axis thereof.

10. A dryer drum as set forth in claim 9 wherein said shell has a radial flange at each end directed towards said axis of said shell and said header pipe has a journal at each end opposite a respective flange, and which further comprises a stationary bearing housing at each end of said header pipe between said header pipe and a respective flange, and a spherical bearing surface on each respective journal and rotatably mounted in a respective bearing housing.

11. A dryer drum as set forth in claim 9 wherein said means includes a plurality of radial tie rods secured to said steam drum and a plurality of U-shaped brackets disposed about said header pipe, each said bracket having a pair of threaded shanks passing through a respective tie rod and nuts on each shank for securing each respective bracket to a respective tie rod.

12. A dryer drum as set forth in claim 11 further comprising a plurality of bolts, each said bolt being threaded into a respective tie rod and being disposed in abutting relation to said header pipe.

* * * * *

UNITED STATES PATENT AND TRADEMARK OFFICE

CERTIFICATE OF CORRECTION

PATENT NO. : 4,184,268

DATED : January 22, 1980

INVENTOR(S) : Alan Christin and Anton Zembrot

It is certified that error appears in the above—identified patent and that said Letters Patent is hereby corrected as shown below:

Column 3, line 22, change "pipe" to --pipes--.

Column 5, line 24, change "sets" to --set--.

Signed and Sealed this

*Seventeenth* Day of *June 1980*

[SEAL]

*Attest:*

SIDNEY A. DIAMOND

*Attesting Officer*

*Commissioner of Patents and Trademarks*